US006666173B2

(12) United States Patent
Dick

(10) Patent No.: US 6,666,173 B2
(45) Date of Patent: Dec. 23, 2003

(54) HOT GAS LIQUID HEATER

(76) Inventor: David R. Dick, 57 Dick Rd., R.R.#4, Dunville, Ontario (CA), N1A 2W3

( * ) Notice: Subject to any disclaimer, the term of this patent is extended or adjusted under 35 U.S.C. 154(b) by 0 days.

(21) Appl. No.: 10/155,031

(22) Filed: May 28, 2002

(65) Prior Publication Data

US 2003/0029441 A1 Feb. 13, 2003

Related U.S. Application Data

(60) Provisional application No. 60/297,531, filed on Jun. 13, 2001.

(51) Int. Cl.[7] ..... F22B 5/02

(52) U.S. Cl. ..... 122/18.4; 122/18.1; 122/19.1; 122/367.2; 122/248

(58) Field of Search ..... 122/18.1, 18.4, 122/19.1, 15.1, 367.1, 367.2, 367.3, 248; 165/155

(56) References Cited

U.S. PATENT DOCUMENTS 2,559,272 A * 7/1951 Beck ..... 165/128
4,357,910 A * 11/1982 Blockley et al. ..... 122/248
4,449,485 A * 5/1984 Tan ..... 122/209.1
4,782,815 A * 11/1988 Friedman et al. ..... 122/18.4
5,232,682 A * 8/1993 DuPont ..... 423/648.1

* cited by examiner

*Primary Examiner*—Jiping Lu
(74) *Attorney, Agent, or Firm*—Robert F. Dalbridge

(57) ABSTRACT

A hot gas water heater has a housing, and at least a pair of concentric coils in the housing through which liquid to be heated is sequentially passed. Each coil has a helical tube with adjacent turns connected by a web member such that the tube and web member form an imperforate coil wall. Hot gas passes sequentially between the coils in co-current flow with liquid flow in one adjacent coil and counter-current flow with liquid flow in another adjacent coil.

5 Claims, 3 Drawing Sheets

HOT GAS LIQUID HEATER

RELATED APPLICATION

This application claims priority from U.S. Provisional Patent Application No. 60/297,531 filed Jun. 13, 2001.

FIELD OF INVENTION

This invention relates to liquid heaters in which liquid flowing therethrough is heated by hot gas also flowing therethrough. The liquid may be water, but may of course be another liquid.

BACKGROUND OF THE INVENTION

Liquid heaters of the above general kind are well known. Usually, the liquid flows through at least one heat conducting pipe over which hot gas passes to heat the liquid therein. Problems which can arise with known water heaters of this kind include thermal shock imparted to the structure of the heater by temperature differences which occur within the heaters and corrosion caused by the hot gas or the liquid being heated.

It is therefore an object of the invention to provide an improved water heater of this kind in which such problems are minimized.

SUMMARY OF THE INVENTION

According to the invention, a hot gas water heater has a housing containing at least a pair of concentric spaced coils through which liquid to be heated is sequentially passed. Each coil has a helical tube with adjacent turns being connected by a web member such that the tube and web member form an imperforate coil wall. Hot gas is passed sequentially between the coils such that its flow is co-current with liquid flow in one adjacent coil and counter-current with liquid flow in another adjacent coil.

The hot gas may flow between a pair of adjacent coils in co-current flow with the liquid flow in the inner coil and in counter-current flow to the liquid flow in the outer coil.

The housing may have a central hot gas inlet through which hot gas passes to a central passage in the inner coil and a gas outlet which receives gas from a passage between an outer coil and a coil adjacent thereto.

At lease one coil may taper towards an adjacent coil in the direction of gas flow therethrough. There may be at least three or at least four concentric coils provided.

BRIEF DESCRIPTION OF THE DRAWINGS

One embodiment of the invention will now be described, by way of example, with reference to the accompanying drawings, of which.

DESCRIPTION OF PREFERRED EMBODIMENTS

Figure 1:
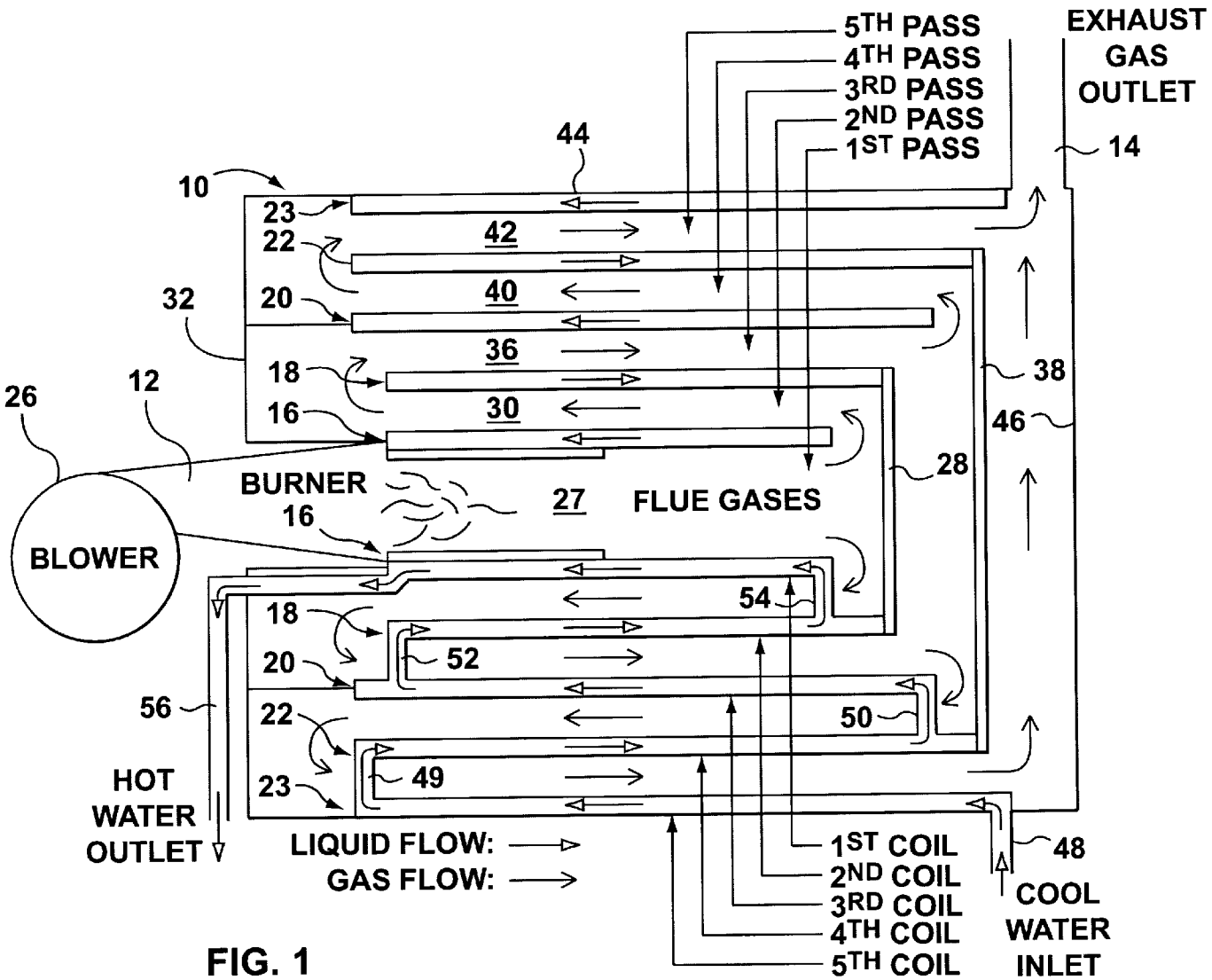
FIG. 1 is a somewhat diagrammatic side view of a hot gas water heater in accordance with one embodiment of the invention.
Figure 2:
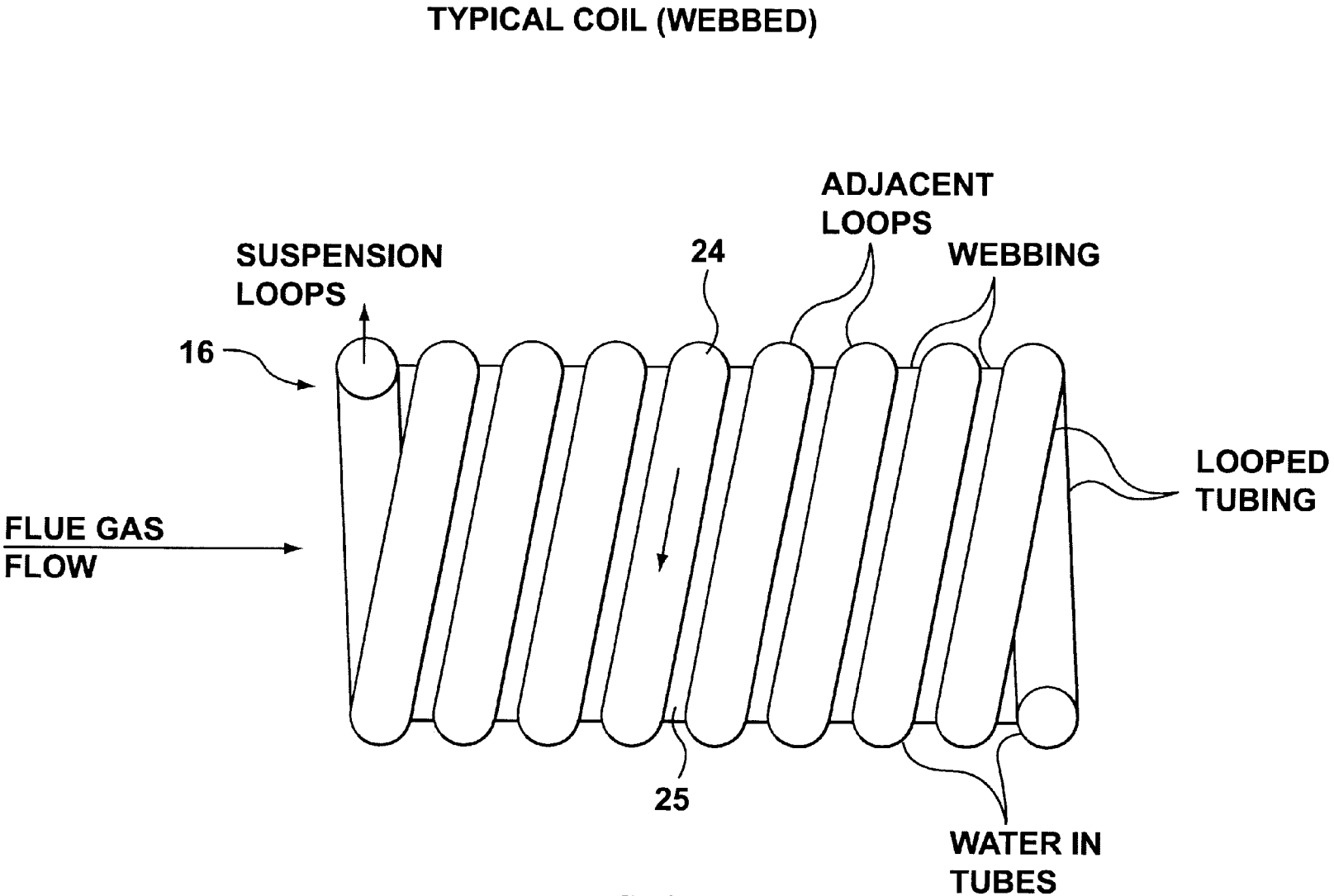
FIG. 2 is a side view on an enlarged scale of a portion of one of the water carrying coils of the water heater.

Referring first to FIGS. 1 and 2 of the drawings, a hot gas water heater has a cylindrical housing 10 with a central hot gas inlet 12 at one end and a gas outlet in the form of a chimney 14 at the other end. The housing 10 contains five concentric water-carrying metal coils 16, 18, 20, 22, 23 each constructed in the manner shown in FIG. 2. The coil shown in FIG. 2 is identified as coil 16, but it will be understood that the other coils 18, 20, 22, 23 are similarly constructed.

As shown in FIG. 2, the coil 16 comprises a helical water-carrying tube 24 with adjacent turns of a helical tube 24 being connected by a web member 25 such that the tube 24 and web member 25 form an imperforate annular coil wall.

The coils 16, 18, 20, 22 are supported in the housing in any suitable manner (not shown), preferably by suspension loops or an appropriate bottom support structure to provide a non-rigid mounting therein. The coil 16 has the smallest diameter and has one end located adjacent the gas inlet 12. The coil 18 surrounds the coil 16 in spaced relationship therewith, the coil 20 surrounds the coil 18 in spaced relationship therewith, the coil 22 surrounds the coil 20 in spaced relationship therewith, and the coil 23 surrounds the coil 22 in spaced relationship therewith.

A gas burner and blower assembly 26 located adjacent the inlet 12 is operable to blow hot gas into the adjacent end of a central passage 27 formed by the coil 16. The hot gas passes along the central passage 27 and, at the opposite end of the coil 16, the hot gas encounters a circular wall 28 extending across the adjacent end of coil 18 which causes the hot gas to undergo a 180° change of direction and pass along an annular passage 30 between the coil 16 and the coil 18.

After passing along the annular passage 30, hot gas encounters an end wall 32 of the housing 10 and an annular barrier 34 between the housing end wall 32 and the adjacent end of the coil 20. The hot gas is thereby caused to undergo a 180° change of direction and pass along an annular passage 36 between the coil 18 and the coil 20. Similarly, after passing along the annular passage 36, the hot gas encounters a wall 38 extending across the adjacent end of coil 22 which causes the gas to undergo a further 180° turn and pass along an annular passage 40 between the coil 20 and the coil 22.

After passing along the annular passage 40, the hot gas engages the end wall 32 of the housing 10 which causes the gas to undergo a further 180° turn and pass along an annular passage 42 between the coil 22 and the coil 23, which is secured to a horizontal annular wall 44 of the housing 10. After passing along the passage 42, the hot gas engages an opposite end wall 46 of the housing 10 and travels upwardly to leave the housing 10 through the chimney 14.

Cool water enters one end of outermost coil 23 through an inlet 48 and travels to the other end of the coil 23 by passing through its helical tube 24. At the other end of coil 23, the water passes through a transfer conduit 49 into one end of coil 22 and passes through its helical tube 24. At the other end of the coil 22, the water passes through a transfer conduit 50 into one end of coil 20 and passes through its helical tube 24. At the other end of coil 20, the water passes through a transfer conduit 52 into one end of coil 18 and passes therealong. At the other end of the coil 18, the water passes through a transfer conduit 54 to innermost conduit 16 and passes therealong. At the other end of conduit 16, the water leaves the housing through outlet 56.

Thus, in use, hot gas from the burner and the blower assembly 26 passes along passages 27, 30, 36, 40 and 42 and transfers its heat through the coil walls to the water flowing therein, so that relatively cool water entering the inlet 48 is substantially heated by the time it reaches the outlet 56. Likewise, the hot gas supplied by the burner and blower assembly 26 will have substantially cooled by the time it leaves the heater through chimney 14.

It will be noted that, in accordance with the invention, the flow of hot gas through an annular passage between a pair of adjacent coils, i.e. annular passage 30, 36,40 or 42, is co-current with the flow of water in the inner coil and counter-current to the flow of water in the outer coil, as can readily be observed from the arrows indicating the direction of water and gas flow in FIG. 1. This provides less thermal shock on the water heater than would otherwise be the case.

Figure 3:
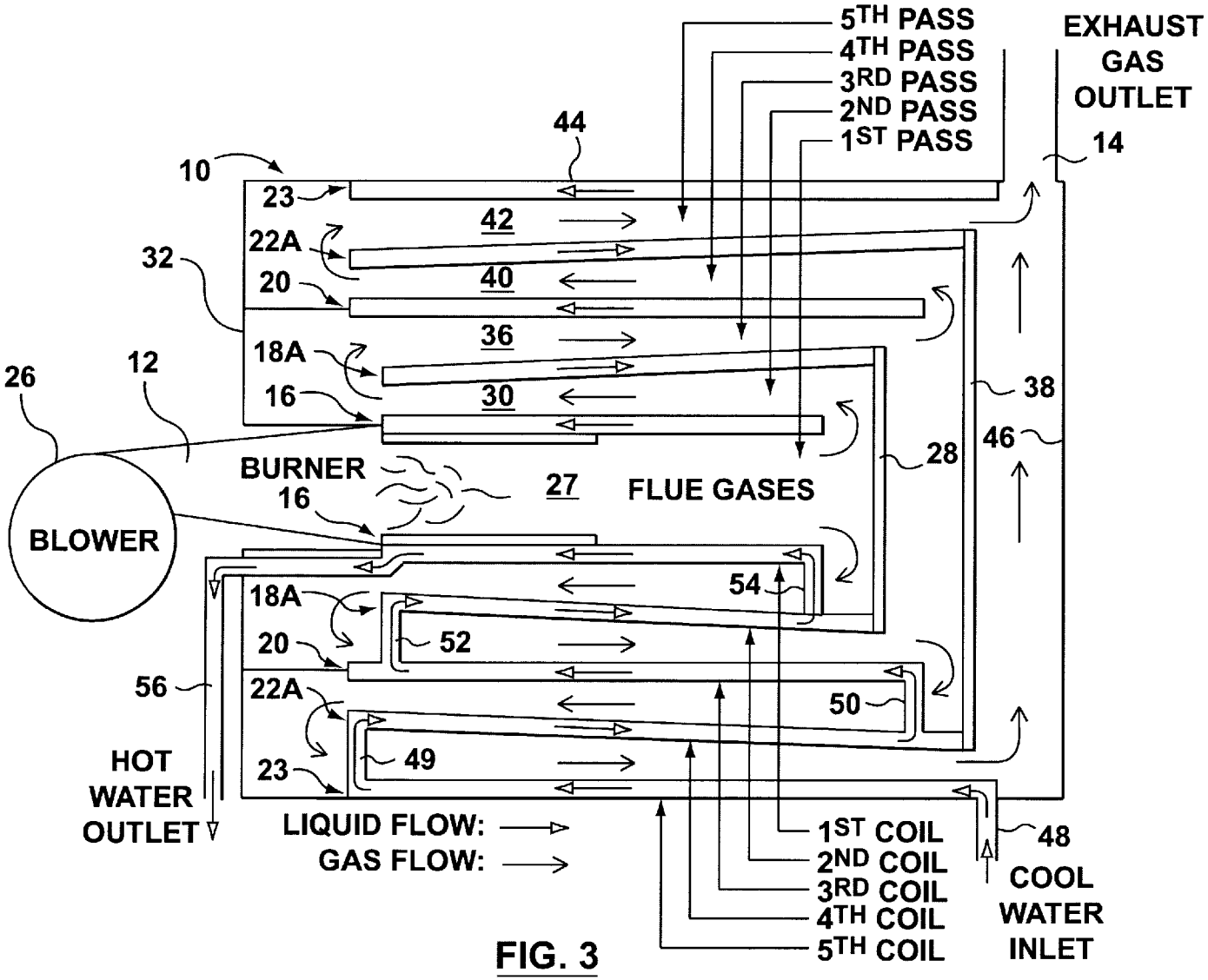
FIG. 3 is similar to FIG. 1 but shows another embodiment of the invention.

FIG. 3 is similar to FIG. 1 but shows another embodiment of the invention. For ease of explanation, the same reference numerals are used to identify the same parts. In the embodiment of FIG. 3, coils 18A and 22A taper towards adjacent inner coils 16 and 20 respectively in the direction of flow of the gas to compensate for the contraction of the gas as it cools.

Other advantages and embodiments of the invention will now be readily apparent to a person skilled in the art from the foregoing description of a preferred embodiments, the scope of the invention being defined in the appended claims.

What is claimed is:

1. A hot gas water heater having:

a housing, and at least a pair of concentric coils in the housing through which liquid to be heated is sequentially passed, each coil having a helical tube with adjacent turns connected by a web member such that the tube and web member form an imperforate coil wall, whereby hot gas passes sequentially between the coils in co-current flow with liquid flow in one adjacent coil and counter-current flow with liquid flow in another adjacent coil, and at least one coil tapering towards an adjacent coil in the direction of gas flow therebetween to compensate for contraction of the gas as it cools.

2. A hot gas water heater according to claim 1 wherein hot gas flows between a pair of adjacent coils in co-current flow with liquid flow in the inner coil and counter-current flow with liquid flow in the outer coil.

3. A hot gas water heater according to claim 1 wherein the housing has a central hot gas inlet through which hot gas passes to a central passage through the inner coil and a gas outlet which receives gas from a passage between an outer coil and a coil adjacent thereto.

4. A hot gas water heater according to claim 1 wherein at east three said concentric coils are provided.

5. A hot gas water heater according to claim 1 wherein at least four said concentric coils are provided.

* * * * *